US006318284B1

(12) United States Patent
Van Rompay

(10) Patent No.: US 6,318,284 B1
(45) Date of Patent: Nov. 20, 2001

(54) METHOD AND INSTALLATION FOR CARRYING OUT OPERATIONS UNDER WATER WITH A CRANE ON A FIXED PONTOON

(76) Inventor: Boudewijn Gabriël Van Rompay, Hensberglei 17, B-2930 Brasschaat (BE)

( * ) Notice: Subject to any disclaimer, the term of this patent is extended or adjusted under 35 U.S.C. 154(b) by 0 days.

(21) Appl. No.: 09/573,978

(22) Filed: May 19, 2000

(30) Foreign Application Priority Data

May 19, 1999 (BE) ..... 09900350

(51) Int. Cl.[7] ..... B63B 1/00

(52) U.S. Cl. ..... 114/61.1; 114/315; 114/268; 405/203

(58) Field of Search ..... 114/312, 315, 114/268, 269, 61.1, 313; 405/195.1, 196, 201, 203

(56) References Cited

U.S. PATENT DOCUMENTS 3,996,870 * 12/1976 Haavie ..... 114/312
4,157,229 * 6/1979 Kumm ..... 114/312
5,447,391 * 9/1995 Gallaher et al. ..... 405/203

FOREIGN PATENT DOCUMENTS 33 47 926 8/1985 (DE) .
0 205 341 12/1986 (EP) .
0 749 384 8/1997 (EP) .
60073921 4/1985 (JP) .
11131523 5/1999 (JP) .

* cited by examiner

*Primary Examiner*—Stephen Avila
(74) *Attorney, Agent, or Firm*—Bacon & Thomas PLLC

(57) ABSTRACT

Method for carrying out operations under water by means of a crane (3) equipped with a tool which is erected on a pontoon (1) which has been fixed and which can be jacked up, wherein an underwater working room (4) which is mainly open at the bottom is let down on the place of work, in that the water is pushed out of this working room (4) by means of compressed air, in that the place of work is divided in compartments in the working room (4) itself, i.e. out of the water, and in that one or several positions of the compartment division in which the crane (3) will have to carry out an operation are transmitted to the crane (3), after which the underwater working room (4) is lifted and the crane carries (3) out the operation.

12 Claims, 4 Drawing Sheets

METHOD AND INSTALLATION FOR CARRYING OUT OPERATIONS UNDER WATER WITH A CRANE ON A FIXED PONTOON

BACKGROUND OF THE INVENTION

1. Field of the Invention

The present invention concerns a method for carrying out operations under water by means of a crane equipped with a tool which is erected on a pontoon which has been fixed and which can be jacked up.

In particular, the invention is related to the demolition of wrecks lying under water, for example on the bottom of the sea.

2. Discussion of the Related Art

The crane in this case has a tool such as a pair of shears or such at the end of its flexible arm with which pieces of the wreck can be loosened and pulled away.

As the wreck is situated under water, it is usually impossible for the crane attendant to see how he should operate said crane and especially the tool on the arm.

He may get his instructions from divers situated in the vicinity of the wreck and who can communicate with him.

In many cases, however, it is not possible for divers to follow and direct the operations of the crane, for example when there is a strong flow, at large depth or when there is not enough visibility. Moreover, divers can only stay under water for a relatively short time, so that this working method is relatively slow and expensive.

SUMMARY OF THE INVENTION

The invention aims a method which remedies these and other disadvantages and which makes it possible to carry out the operations under water by means of a crane in a fast and accurate manner, also in those circumstances where it is impossible to use divers to give instructions to the crane attendant.

This aim is reached according to the invention in that an underwater working room which is mainly open at the bottom is let down on the place of work, in that the water is pushed out of this working room by means of compressed air, in that the place of work is divided in compartments in the working room itself, i.e. out of the water, and in that one or several positions of the compartment division in which the crane will have to carry out an operation are transmitted to the crane, after which the underwater working room is lifted and the crane carries out the operation.

The crane can be operated by a person on the basis of the information, which is for example converted into an image on a screen, but the crane is preferably computer-controlled, in particular numerically controlled, as a function of the information related to the place of activity, which is received from the underwater working room.

Use is preferably made of a construction containing a second pontoon which can be jacked up, which has been jacked up in the immediate vicinity of or above the place of work, and which carries the underwater working room which can be moved up and down over a guide in relation to this second pontoon, and also containing means to move said underwater working room up and down, as well as means to blow compressed air in the underwater working room.

The underwater working room can be placed on an object to be treated, for example on a ship wreck to be demolished, whereby the division in compartments consists in creating a fictitious grid on the surface of the object.

Use can be made of an underwater working room whose bottom is made of a grid.

The co-ordinates of the points where the crane has to carry out an operation can be given by one or several persons who go down in the underwater working room.

Naturally, the position of the underwater working room in relation to the crane must be known. It can be derived from the fixed position of the two pontoons which have been jacked up in relation to one another, but a position finding is preferably carried out by means of calibration, whereby contact is made with the underwater working room, which has been lowered onto the place of work, by means of a part of the crane, in particular a tool at the end of the crane arm.

The invention also concerns an installation for carrying out the method according to any of the preceding embodiments.

The invention thus concerns an installation for carrying out operations under water, characterized in that it contains two pontoons which can be jacked up, a first one onto which is provided a numerically controlled crane and which can work with a tool under water, and a second one which is provided with a guided underwater room which can be moved up and down and which has a mainly open bottom side, in that it contains means for moving this underwater working room up and down and means for pumping compressed air in this underwater working room.

Said crane preferably has a capacity between 50 and 100 ton.

The open bottom of the underwater working room may be formed of a grid.

BRIEF DESCRIPTION OF THE DRAWINGS

In order to better explain the characteristics of the invention, the following preferred embodiments of a method and installation for working under water according to the invention are described as an example only without being limitative in any way, with reference to the accompany g drawings, in which.

DESCRIPTION OF THE PREFERRED EMBODIMENT

Figure 1:
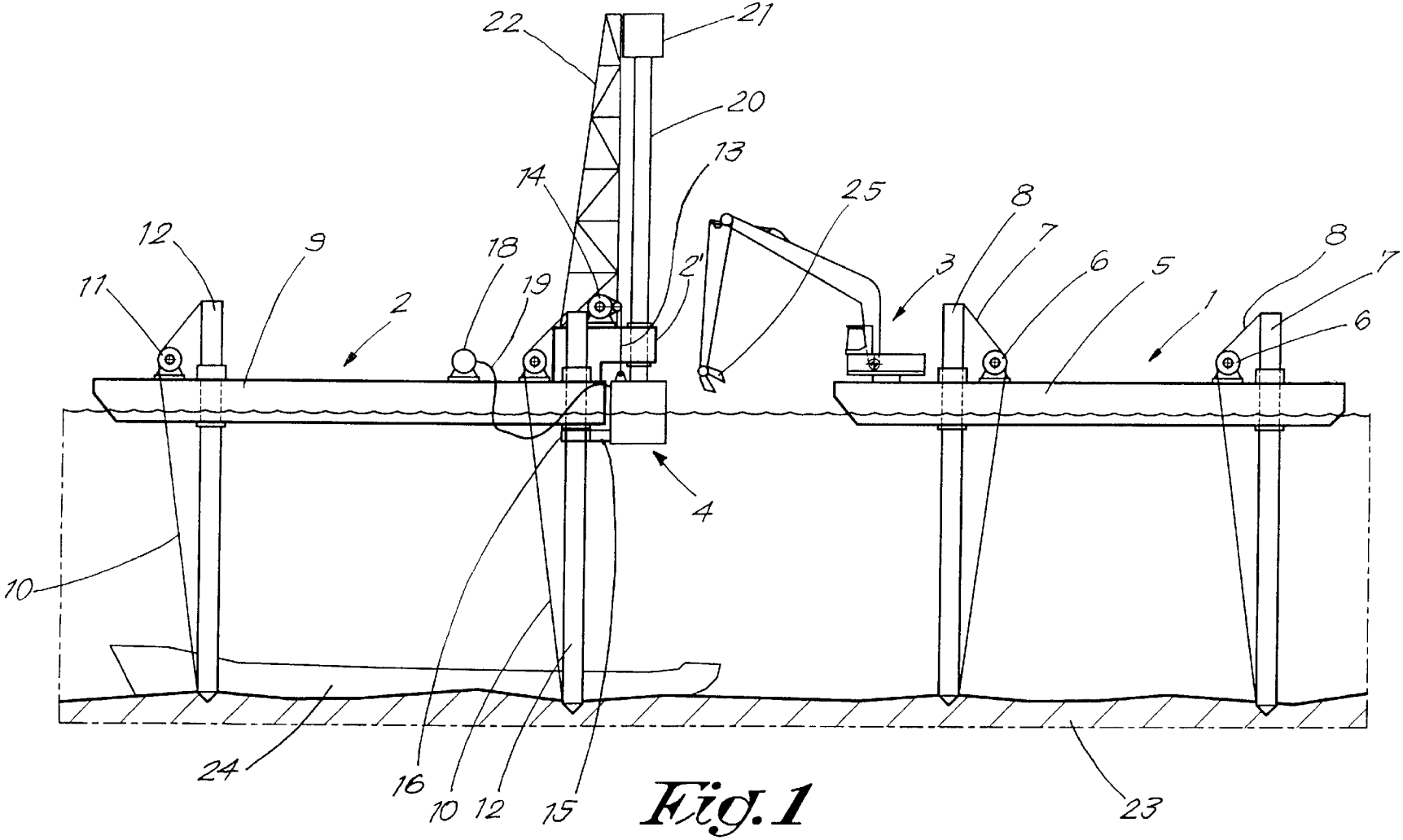
FIG. 1 schematically represents an installation according to the invention at the beginning of the operations.

The installation for carrying out operations under water as represented in FIG. 1 mainly contains two pontoons 1 and 2 which can be jacked up, namely a first pontoon 1 onto which is fixed a heavy crane 3 and a second pontoon 2 which is part of a construction which also contains among others an underwater working room 4 which can be moved up and down in relation to the pontoon 2.

The crane 3 is a hydraulic crane with a frame onto which is mounted an arm consisting of at least two parts which can be rotated and tilted up and down. This crane 3, which can work under water with its arm provided with a tool, has a relatively large capacity of 50 to 100 tons. The pontoon 1 which can be jacked up mainly consists of a floating barge 5 and four legs 8 which can be shifted in height in relation to the barge 5 by means of cables 7 which can be moved by means of winches 6.

In a similar way, also the pontoon 2 which can be jacked up consists of a floating barge 9 and four legs 12 which can be shifted in height in relation to the barge 9 by means of cables 10 which are operated by winches 11.

The underwater working room 4 which can be moved up and down is suspended to the barge 9 of the pontoon 2 by means of cables 13 which can be rolled up and unrolled by means of winches 14 and thus form means to move the working room 4 up and down.

These winches 14 consist of an overhanging part 2' at the far end of the pontoon 2.

The underwater working room 4 is guided in relation to the pontoon 2, in the given example by two of the legs 12. The underwater working room 4 is provided with two arms 15 to this end which end in brackets or rings 16 which mesh around the legs 12.

Figure 3:
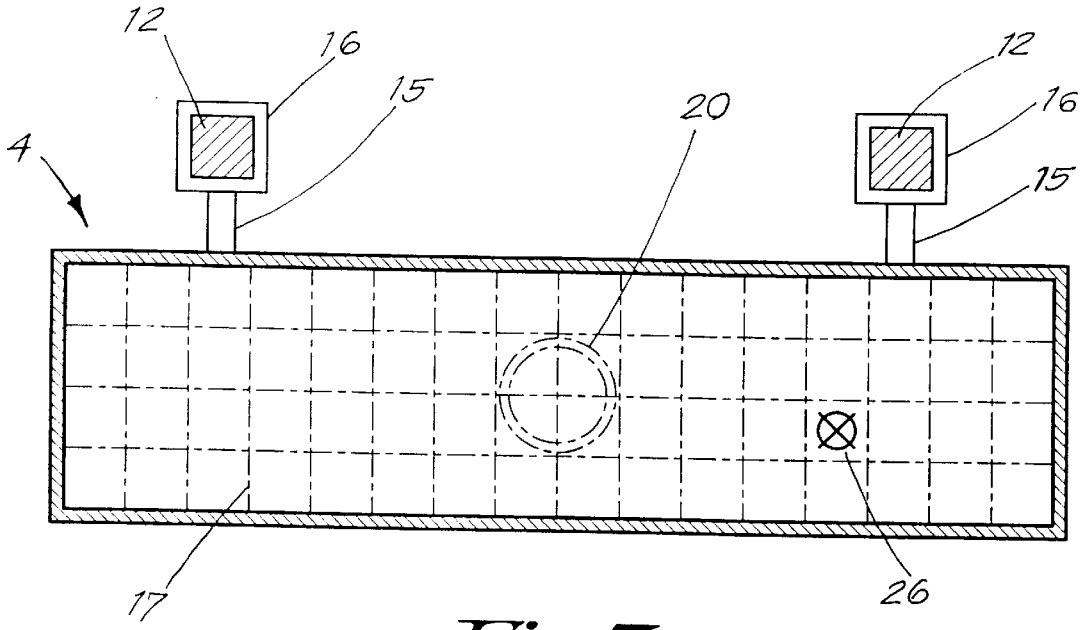
FIG. 3 represents a section to a larger scale according to line III—III in FIG. 2.

The underwater working room 4, which is relatively large, for example some fifteen meters onto three to four meters, is mainly open at the bottom, but a grid 17 is provided in the open bottom side, as is represented in detail in FIG. 3. Mainly open at the bottom means in this application that one can look outside through this bottom and that it is preferably possible to carry out specific small operations outside the underwater working room 4 from the inside.

Said construction with the pontoon 2 and the underwater working room 4 also contains means for pressing compressed air in this underwater working room 4, which means consist of a pump 18 standing on the pontoon 2 and which is connected to the inside of the underwater working room 4 by means of a flexible hose 19.

Possibly, means can be provided, which are not represented in the Figures, to prevent the underwater working room 4 from rising when compressed air is pumped in it. Thus, it can possibly be locked in relation to the legs 12.

The entry to the underwater working room 4 is formed of a standing shaft 20 in which is provided a staircase or elevator and which ends at the top in a lock 21.

This shaft 20 is guided in the elevation 2' and, in order to make the entry to the lock 21 for each position of the underwater working room 4 possible, an access tower 22 is provided next to the shaft 20 on said elevation 2'.

Also on the pontoon 2 can be erected a crane which is much less heavy, however, than the crane 3 and which is only used for operations on the pontoon 2 and not for operations under water at a large depth.

Also inside the underwater working room 4 can be provided cranes or tools, in particular a pair of hydraulic shears, to carry out small operations under water.

In order to demolish a ship wreck 24 lying on the bottom of the sea 23 by means of the crane 3, one proceeds as follows:

The two pontoons 1 and 2 are put in place in a floating manner and the installation is erected, with the pontoon 2 above the ship wreck 24 as represented in FIG. 1.

Figure 5:
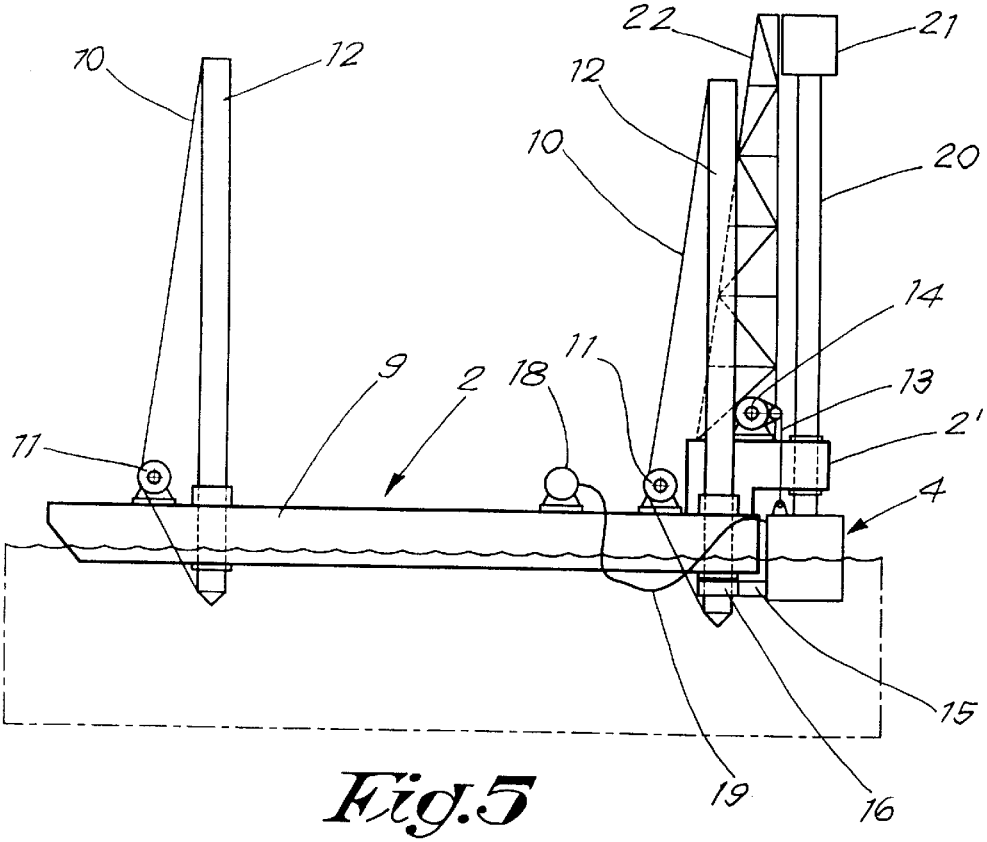
FIG. 5 represents a part of the installation of FIG. 1, as it is being put in place.

FIG. 5 represents the pontoon 2 as being towed in place with the four legs 12 telescoped up and the underwater working room 4 being raised. As soon as this is in place, the legs 12 are telescoped out until they reach the bottom of the sea 23, and the barge 9 is lifted, so that it does not float any longer and thus is stable in relation to the bottom of the sea 23.

In an analogous manner, before or after the pontoon 2, the pontoon 1 is also towed in place with the crane 3, and by telescoping out the legs 8 and lifting the barge 5, it is put fixed on the bottom of the sea 23.

By means of the cables 13 and the winches 14, the underwater working room 4 is lowered along the two legs 12 forming the guide for the latter on the ship wreck 24, after which the pump 18 with compressed air is pumped in this underwater working room 4, as a result of which the water is pumped out.

Figure 2:
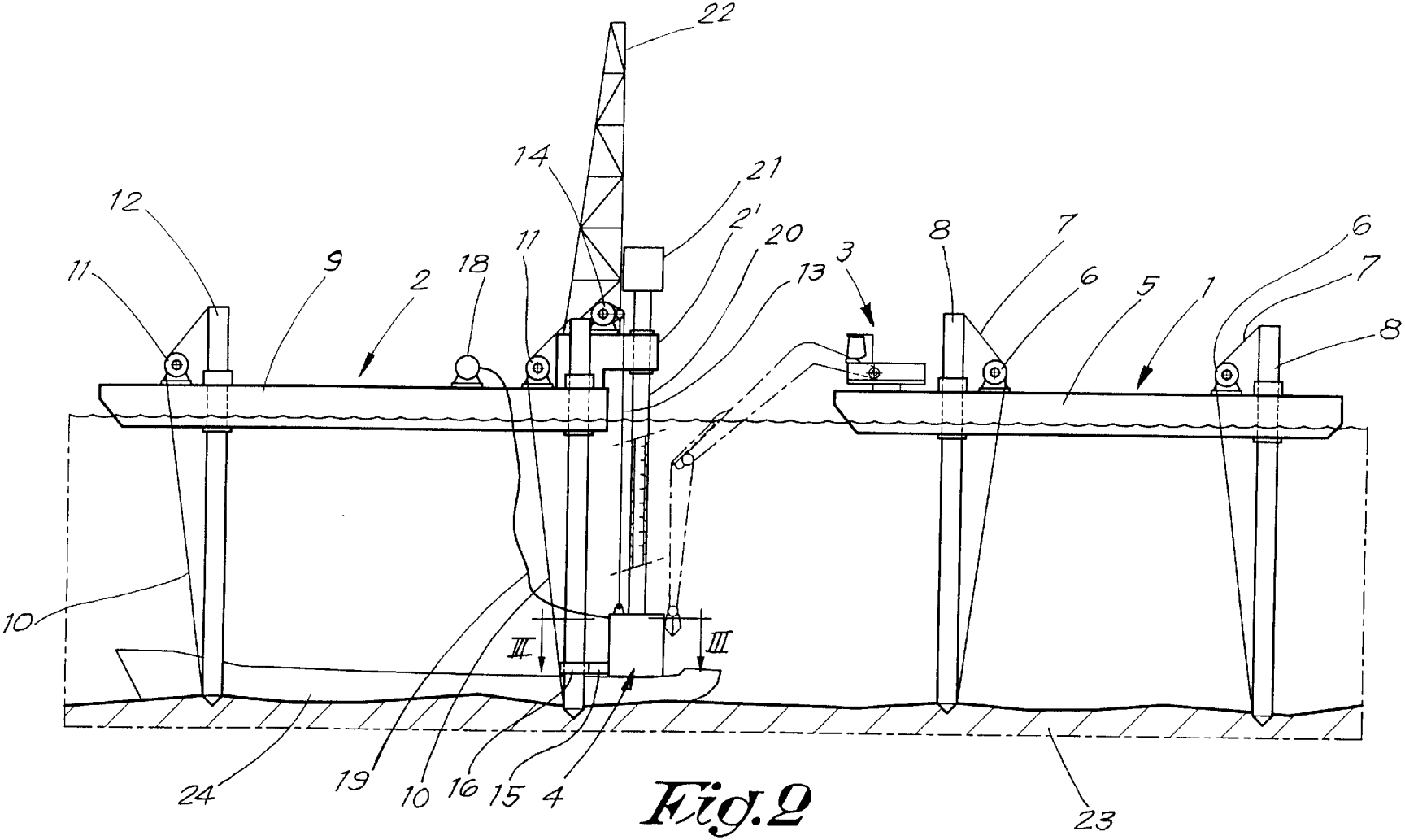
FIG. 2 represents a view of the installation analogous to that in FIG. 1, but during a first stage of the operations.

The installation in this phase of the method is represented in FIG. 2.

The position of the crane 3 in relation to the underwater working room 4 is determined by means of a sort of calibration of the numerical control of this crane 3.

The latter is done by lowering the crane arm with a tray or another tool such as a pair of hydraulic shears 25 until this tray or this pair of shears 25 ticks against a point of the underwater working room 4 or feels the walls thereof.

In this manner, the position of the working room 4 is entered as a data in the computer of the crane control, after which this control can find any point which is indicated by the co-ordinates inside the working room 4.

Via the lock 21 and the shaft 20, also one or several persons descend in the underwater working room 4.

This person or these persons now divide the surface of the shipwreck 24 in compartments, which is visible through the open bottom side, or in other words form a fictitious grid on this surface.

In order to simplify the formation of this fictitious grid, also indications such as marks can be provided at a certain distance on the inside walls of the underwater working room 4.

In this way, positions are determined by the co-ordinates of the grid or compartments of the grid are indicated, there where an operation must be carried out by the crane 3, for example where a piece of the shipwreck 24 has to be cut loose and pulled away by means of the shears 25.

Possibly, the shipwreck 24 can be pre-cut in the working room 4 by means of a small pair of hydraulic shears which is present there.

In FIG. 3, 26 indicates a compartment or a point of the grid whose position has been transmitted to the control of the crane 3 via radio signals or via a cable.

After this position has been transmitted, the underwater working room 4 is sufficiently raised, so that the crane 3 can reach the above-mentioned position on the surface of the shipwreck 24 without hindrance.

Figure 4:
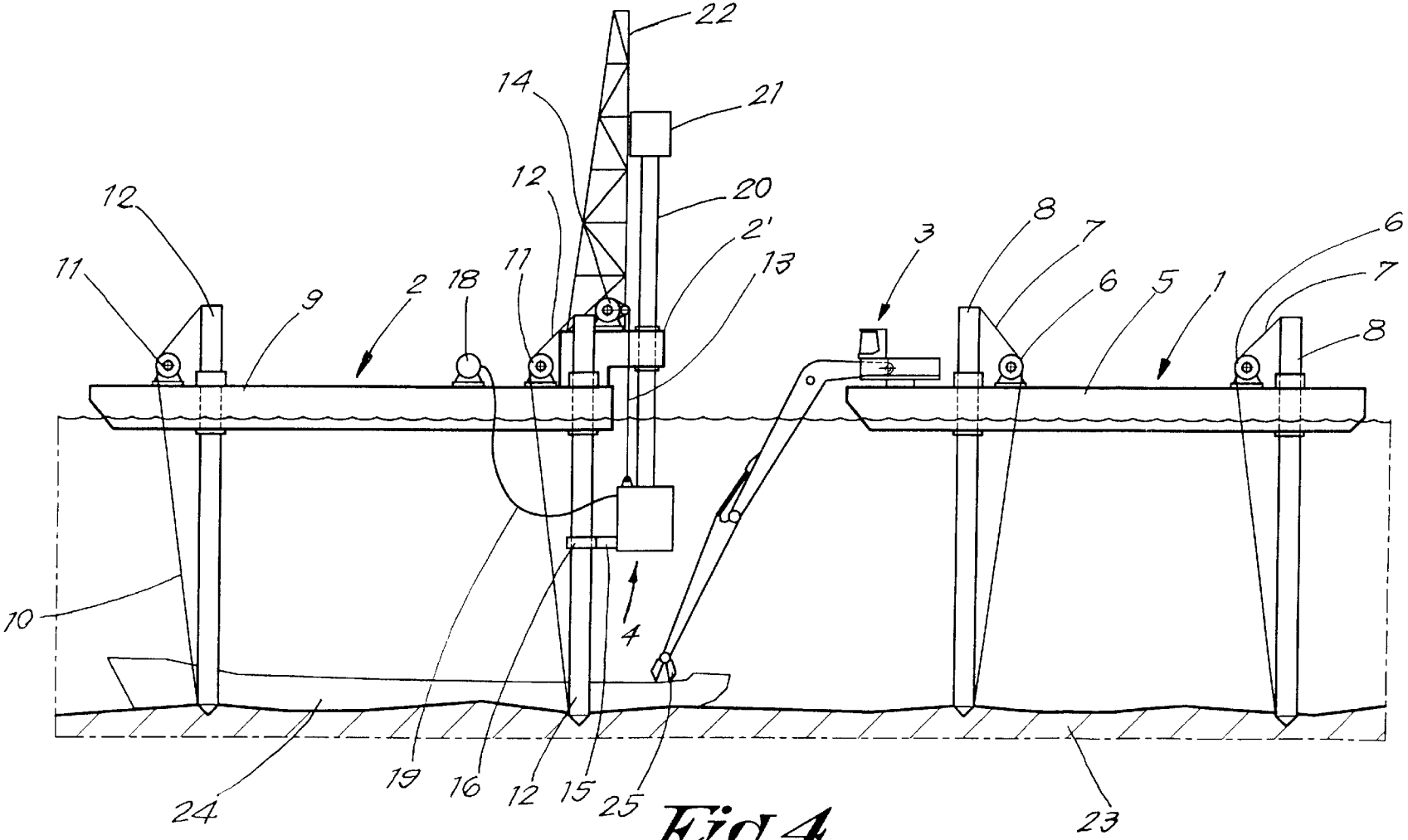
FIG. 4 represents a view of the installation analogous to that in FIG. 2, but during the next step of the operations.

Finally, the crane 3 then carries out the requested operation, this time with relatively great precision, in practice with an accuracy to 5 cm. As represented in FIG. 4, the shears 25 now cut a piece of the shipwreck 24 loose.

After this operation has been finished, the working room 4 is lowered again on the shipwreck 24, a position is again determined and transmitted to the crane control, after which the working room 4 is pulled up and the crane 3 will carry out new operations.

This cycle is repeated until another part of the shipwreck 24 has to be demolished, for which the pontoons 1 and 2 have to be moved a bit, which becomes possible after their legs 8 or 12 have been telescoped up. On this new place, the legs 8 and 12 are telescoped down again, as a result of which the pontoons 1 and 2 are jacked up again, so that they stand on the bottom of the sea 23 in a stable manner.

In this way, ship wrecks 24 can be demolished very fast without divers being required.

The crane 3 can for example cut up to 60 times per hour, pull the pieces away and carry them up, which pieces are then put on the pontoon 1.

Also other operations can be carried out in an analogous manner.

While divers can only work under water at a limited depth and for a short time, the operations can now be carried out at a larger depth of up to 30 m and uninterruptedly, since the working room 4 can be manned for 24 hours.

The underwater working room 4 must not necessarily be guided by two legs 12. It can also be guided by another guide which is fixed to the pontoon 2.

Nor must said working room 4 be suspended to a far end of the pontoon 2. It could for example also be situated in the middle, under an opening in the pontoon 2.

Ultimately, the working room 4 could also be suspended to the pontoon 1 by means of the crane 3.

The invention is by no means limited to the above-described embodiments represented in the accompanying drawings; on the contrary, such a method and installation for carrying out operations under water can be made in all sorts of variants while still remaining within the scope of the invention.

What is claimed is:

1. A method for carrying out operations related to a work site underwater comprising the steps of:

providing a first pontoon having a crane equipped with a tool;

providing an underwater working room generally open along a bottom surface, said working room divided into a series of compartments;

lowering said working room above the work site;

removing water from said working room with compressed air;

lowering said tool into the water;

calibrating the position of the crane with respect to at least one point within one of said compartments;

raising said working room from said work site towards the water surface; and carrying out an operation with said crane related to said work site.

2. The method according to claim 1, wherein a second pontoon supports said working room, said second pontoon including a vertical guide for transporting said working room, said second pontoon further including an air compressor device for transporting compressed air to said working room.

3. The method according to claim 1 wherein said compartments of said working room comprise a fictitious grid located along the bottom surface of said working room.

4. The method according to claim 3 wherein said bottom surface of said working room is provided with a grid that corresponds to said compartments.

5. The method according to claim 1 including the step of sending at least one individual in said working room to assist in determining the position of said tool with respect to said compartments.

6. The method according to claim 1 wherein calibrating said crane with said compartments includes contacting said under water working room with said tool.

7. An installation for carrying out an operation underwater comprising:

a first pontoon supported by at least two extensible legs adapted to be installed into an ocean floor;

a second pontoon supported by at least two extensible legs adapted to be installed into an ocean floor;

a numerically controllable crane supported by said first pontoon, said crane including retractable arms having a tool positioned at a distal end of one of said arms;

an underwater working room; and a vertical guide supported by said second pontoon for transporting said working room between said second pontoon and an underwater work site, said second pontoon further including an air compressor device for transporting compressed air to said working room.

8. The installation according to claim 7 wherein said crane is powered by hydraulics.

9. The installation according to claim 7 wherein a bottom surface of said working room forms a grid.

10. The installation according to claim 7 wherein said at least two extensible legs of said first and second pontoons are telescopic, said at least two extensible legs having end portions adapted to penetrate the ocean floor.

11. The installation according to claim 10 wherein said working room is further guided above and below the water surface by said at least two extensible legs of said second pontoon.

12. The installation according to claim 7 wherein said working room includes a shaft spanning a height of said working room, said shaft terminating at an upper surface of said working room with a lock.

* * * * *